United States Patent [19]

Gibel

[11] 3,951,171

[45] Apr. 20, 1976

[54] SELF-PRESSURE REGULATING AIR EJECTOR

[76] Inventor: Stephen J. Gibel, 5846 Edgerton Road, North Royalton, Ohio 44133

[22] Filed: July 15, 1971

[21] Appl. No.: 162,784

[52] U.S. Cl. ..... 138/42

[51] Int. Cl.[2] ..... F15D 1/00

[58] Field of Search ..... 138/37, 40, 42, 43, 138/44, 45, 46; 181/60; 239/552

[56] References Cited

UNITED STATES PATENTS

| | | | |
|---|---|---|---|
| 2,681,255 | 6/1954 | Downey | 239/552 |
| 3,537,543 | 11/1970 | Gibel | 138/42 X |
| 3,592,237 | 7/1971 | Borschers | 138/43 |
| 3,630,455 | 12/1971 | Parkison | 138/46 X |

*Primary Examiner*—William Price
*Assistant Examiner*—Ro E. Hart
*Attorney, Agent, or Firm*—Ely & Golrick

[57] ABSTRACT

Discharge pressure limiting and noise-suppressing nozzle for air-ejectors. An internal surface distributing air from an internal central pressure-reducing orifice to radially located multi-jet parts is dished in the direction of overall air flow through nozzle. Back-turbulence limits excessive line pressure to safe discharge pressure from nozzle.

7 Claims, 2 Drawing Figures

INVENTOR.
STEPHEN J. GIBEL
BY
ELY, GOLRICK & FLYNN
ATTORNEYS

SELF-PRESSURE REGULATING AIR EJECTOR

This invention relates to an improvement in the construction of nozzles for ejecting and/or moving objects by relatively quiet air-blasts at safe ranges of blast pressures despite increased pressures in the air-supply line. It is particularly adapted for multi-jet nozzles as disclosed in my U.S. Pat. No. 3,537,543 issued Nov. 3, 1970. A particular object and advantage of this construction is that it will continue to operate within a safe range without shutting off the discharge blast if the line-pressure becomes excessive and, further, it is not susceptible to tampering whereby its safe operation can be interfered with carelessly or deliberately.

Appropriately directed blasts of air are commonly desired for the quick and convenient removal of stamped or molded parts from forming dies, for moving small parts along conveyor chutes, and the like. A major objection to the use of such ejectors was their shrill noise; this can become a particularly objectionable intermittent shop-noise when, for example, a stamping or molding machine operator, holding a manually directed air-line hose, momentarily opened a valve in the line to provide a sudden blast of air by which a stamped or molded part can be blown out of or off the opened dies in which it was formed. Such noise-pollution can be greatly abated by use of a multi-jet nozzel as disclosed in my above patent.

Another and heretofore continuing very serious objection to the use of air ejectors has been the safety factor. The average line pressure of the air-supply required in shops for operation of paint sprayers, pneumatic tools, cylinders, and the like greatly exceeds that which can be used for example in conveniently hand-held air-ejectors; if air for this purpose is discharged at full line pressure, smaller parts particularly may be ejected at such high velocity as to become flying missiles endangering not only the operator but other personnel within substantial distances of the machine from which the part is ejected as well as often damaging the parts themselves. Pressure reducing valves which maintain a fixed ratio between the full line pressure and a reduced pressure at which air is delivered to an air-ejector nozzle do not solve the problem due to wide and sudden fluctuations in the pressure of the air-supply line. Conventional line pressure-regulating valves are very expensive if installed in each line connecting an individual air-ejector nozzle to the main line of shop air and may be either insensitive to dangerous fluctuations in main-line pressure or over-sensitive and, thus, themselves become a cause of fluctuations in the pressure of air delivered to a given nozzle. The foregoing problem of holding the discharge pressure of air at each individual air-ejector nozzle to safe limits has become accentuated by the failure of some plant managements and/or workers to observe self-enforced safety rules and the consequent imposition by governmental regulations of the maximum discharge pressure at which air-ejector nozzles may be operated.

Heretofore two expedients have been employed in each air ejector nozzle to limit its force. One such expedient has been to incorporate just ahead of the discharge tube a ball-type check valve normally held open by a compression spring acting through the valve seat to hold the ball valve open, whereby increased line pressure moves the ball toward the seat to increase the constriction of the valve ball with respect to the seat and the constriction effected by spiral turns of the compression spring. Such throttling valves are initially satisfactorily operative within a relatively narrow range of fluctuations but otherwise have several objectionable disadvantages: (a) Relatively frequent line pressures in excess of the limited range of pressure for which the valve supplies air in operative quantities and pressures to the ejection nozzle can completely shut off air or so restrict its flow as to render the ejector completely inoperative or so nearly so as to seriously interfere with production; the frequency of such complete or partial inoperativeness increases as the check-valve spring weakens in use. (b) The valve may become inoperative due to other wear or breakage of the moving parts upon which its function depends or due to the clogging of the valve by the gumming of oil or other solid and liquid particles normally entrained in the air, requiring frequent disassembly for maintenance and cleaning. (c) The shrill noise generated in a conventional ejector tube or in the valve itself by the high velocity air may set up harmonic frequencies causing the valve to flutter, thereby impairing the effectiveness of the ejector. To avoid the shut-offs experienced with the above described check-valves, another expedient has been to introduce air through a narrow flow-constricting nozzle within an air-ejector discharge tube, the nozzle being connected directly to the full line pressure through a normally operated shut-off valve. Adjacent this fixed flow-constricting nozzle the ejector tube is provided with one or more openings to the shop atmosphere, whereby the combined internal nozzle and perforated ejector tube functions as an aspirator of the shop atmosphere. That is, as the velocity of air delivered by the internal nozzle may increase due to a rise in pressure in the supply line, an increased proportion of air delivered by the ejector tube is aspirated into the tube through its openings, thereby holding the pressure and velocity of air delivered by the ejector tube within safe limits. Such devices are extremely noisy and by no means safe in actual operation; if the aspirating openings in the normally hand-held ejector tube are accidentally closed by the operator's hand, the device cannot function to reduce the discharge pressure and a part may be ejected at a dangerous velocity. Worse, irresponsible operators have been known to deliberately cover such aspirating opening and to place a small object into the nozzle of the ejector tube; the ejector tube then becomes an air-gun by which the inserted object can be shot at other workers or equipment by quickly opening the shut-off valve.

It is an object of this invention to provide a nozzle which avoids the shut-downs and other objections of the above described check valves. It has no moving parts, eliminating the need for frequent cleaning and maintenance. It depends for its function upon the internal configuration of its elements; thereby eliminating the accidental mis-use or deliberate abuse of the above described aspirator types. It is extremely quiet in its operation. Other objects and advantages will be apparent from the following specification, claims, and drawings, in which:

Figure 1:
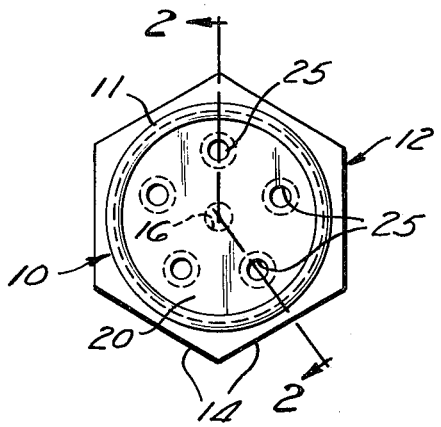
FIG. 1 is an end view of an air ejector nozzle embodying the invention.
Figure 2:
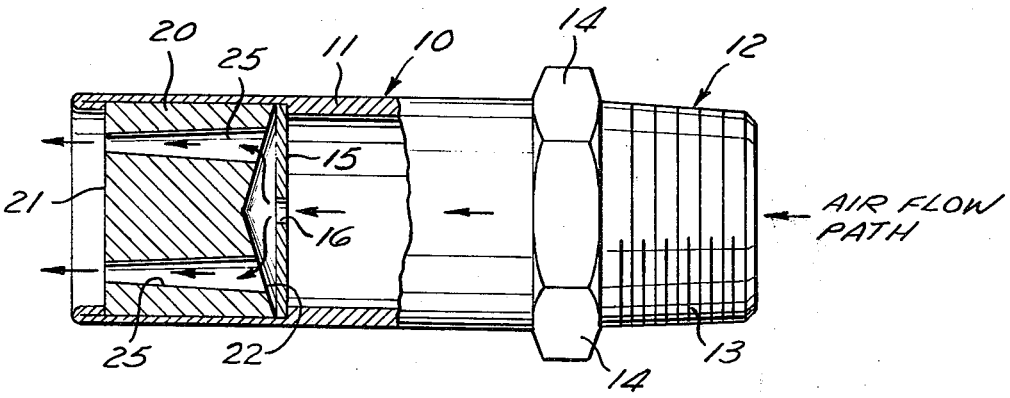
FIG. 2 is a side view, partly in section, along the line 2—2 of FIG. 1.

As shown in the drawings, the device 10 comprises a casing or sleeve 11 carrying at one end a fitting 12 whereby the device may be connected to the supply of high-pressure shop air, often through a flexible hose or jointed piping, allowing the operator to direct manually a blast from the device at the article to be moved. In this illustrated embodiment, the fitting 12 is provided with pipe threads 13 and a head having nut faces 14 permitting the device 10 to be coupled directly to a hand-held, button-operated, quick opening but normally closed shut-off valve in turn connected to the flexible hose or jointed piping leading to the shop air line. The device 10 may, thus, be aimed at the object to be moved and operation of the shut-off valve will cause a blast of air to be directed at and move the object.

The cross-sectional area of the casing 11 is preferably greater than the bore of the fitting 12. The end of the casing 11 opposite the fitting 12 is counter-bored to receive a disk 15 having a central orifice 16. The disk 15 is retained between the shoulder provided by the counter-bore and a plug 20 in turn retained in the casing by a spun-over extension of the casing beyond the discharge face 21 of the plug.

The plug is perforated lengthwise by a plurality of holes 25 having longitudinal axes equally spaced from each other and at equal radial distances from the axis of the plug 20 so as to locate the discharge ends of the holes 25 on a circle concentric with and relatively adjacent the spun-over end of the casing 11. The holes 25 are preferably tapered to function as nozzles; their size and number and the length of the plug 20 are preferably according to the proportions of the similar plug 25 disclosed in my above U.S. Pat. No. 3,537,543.

The inlet surface 22 of the plug 20 from which the inlet parts of the nozzles 25 open is dished in the overall direction of flow of air through the device so as to provide a conical surface having a component extending opposite to that over-all direction. The central portion of the surface 22 is solid opposite the orifice 16 in the adjacent disk 15, but its minimum operative depth of dishing is somewhat deeper than that which is operative for the corresponding surface 22 disclosed in my above patent. If the acute cone angle of an element of the conical surface 22 with respect to its axis is increased to over 80° , the pressure-regulating effect obtained in cooperation with the perforated disk 15 noticeably decreases; optimum pressureregulating appears to be reached as this cone angle approaches 70° and remains approximately the same or with no significant increase in efficiency as this cone angle is decreased to provide a still deeper dishing of the surface 22.

Another critical proportion of the device appears to be in the proportion of the cross-sectional area of the orifice 16 with respect to the cross-sectional area of the bore of the fitting 12. If this area of the bore to the area of the orifice 16 is greather than approximately 20 to 1, the pressure-regulating function of the device is not impaired, but the total flow of air through it is so reduced as to make the device inefficient for the size of pipe or tubing by which air is supplied to the ejector device; however, as the area of the orifice opening 16 with respect to the bore of the fitting is increased beyond the order of 10 to 1, the pressure-regulating function of the device lessens. Within these operative proportions, the following results were obtained:

EXAMPLE 1

With a 20:1 ratio of the area of the bore of the fitting 12 to the area of the orifice 16 connected to an air supply of 90 p.s.i. (the normal minimum pressure required in most shops for operation of other pneumatic devices), the actual discharge pressure from the device 10 was measured at 18 p.s.i. by a gauge connected according to standardized practice to the discharge end of the device 10 — that is, by a T-fitting allowing lateral discharge from the inlet of an air pressure gauge mounted in alignment with the axis of the device 10 and spaced sufficiently therefrom to obtain stable readings. This supplied ample air at operative pressure for most air ejector purposes. As the shop air supply pressure was increased to 140 p.s.i. (the maximum safe air pressure normally allowed for shop air lines and well within the limits controlled by line pressure regulating and safety valves), the discharge pressure increased to a maximum of 25 p.s.i. This is safely below the maximum of 30 p.s.i. allowed by safety regulations for air ejectors.

EXAMPLE 2

The same device and set up as described in Example 1 was employed except that the disk 15 was replaced by a disk whose orifice opening was increased so that the ratio of the area of the bore of the fitting 12 to the area of the orifice 16 was increased to a 10:1 ratio. In this test the 90 p.s.i. supply pressure produced a discharge pressure of 23–24 p.s.i. At the maximum line pressure of 140 p.s.i., the discharge was measured at 29–30 p.s.i., at the limit but still in compliance with safety regulations.

At all ranges of operation described in the foregoing examples, the device 10 was very quiet, favorably comparable in sound muffling efficiency to that obtained by air ejectors made according to my above mentioned patent.

So far as it is understood, pressure regulation is achieved by devices made according to this invention as follows: The reduction of line pressure to discharge pressure is primarily achieved by the constriction provided by the orifice 16 in the disk 15. If only this primary reduction were obtained, normal fluctuations in shop-air line pressures could cause the discharge pressures to rise well above accepted safety limits, even if the ratio of the area of the bore of the fitting 12 to the area of the orifice 16 were as great as 20:1 or more. The effect of the dished surface 22, having its apex opposite the center of the orifice 16, is to create a back turbulence which interferes with the flow of air through the adjacent orifice 16 and maintains the requisite pressure drop across the orifice; as the line pressure increases, the flow-retarding effect of such back-turbulence also increases.

It is to be understood that this invention is not to be limited to the specific embodiment disclosed; rather it may be varied by those skilled in the art without departing from the scope of the following claims.

What is claimed is:

1. A pressure-regulating air ejector comprising a casing, means for connecting said casing to an air supply line, a closure for said casing having an orifice therein for restricting the flow of air from said line through said casing and reducing the pressure of air discharged through said orifice below that at which said air is supplied to said casing, and means adjacent and opposite the discharge outlet of said orifice to create a back-turbulence limiting flow through said orifice which turbulence increases as the flow through said orifice increases.

2. Air ejector means as defined in claim 1 in which said means for creating a back-turbulence comprises a plug closing an end of said casing opposite the means for connection to an air supply line, said plug having discharge holes whose opening ports are located away from the projected area of said orifice on the adjacent surface of said plug, the contour of said projected area being re-entrant with respect to the direction of flow through said orifice.

3. Air ejector means as defined in claim 2 in which said casing is cylindrical, the means for connecting said casing to an air supply line is a pipe fitting having a bore of less cross-sectional area than the internal cross-sectional area of said casing, the closure for said casing being a disk in which said orifice is axially located in said casing and said plug is axially aligned with said orifice, the axes of said discharge holes in said plug being three or more in number, substantially parallel to the axis of said plug, and substantially equally spaced from each other.

4. Air ejector means as defined in claim 3 in which the area of the bore of said fitting to the area of said orifice is in the range of 20:1 to 10:1.

5. Air ejector means as defined in claim 4 in which the re-entrant surface of said plug adjacent said orifice is the surface of a right cone whose apex is aligned with the axis of said orifice, the angle of an element of said conical surface with respect to said axis not exceeding 80°.

6. Air ejector means as defined in claim 5 in which the total area of said discharge holes exceeds the area of said orifice.

7. Air ejector means as defined in claim 6 in which the said plug and said disk are of substantially equal diameter and the elements of said conical surface on said plug extend to its periphery to space the apex of said surface from the discharge side of said orifice.

* * * * *